US006293547B1

(12) United States Patent
Shaw et al.

(10) Patent No.: US 6,293,547 B1
(45) Date of Patent: Sep. 25, 2001

(54) MULTI-DIMENSIONAL PUZZLE

(76) Inventors: John R Shaw, 140 N. 9th Ave. #10 B, Beech Grove, IN (US) 46107; Merry Jo Anne Mahan, 19010 Laurel Way, Cottonwood, CA (US) 96022

( * ) Notice: Subject to any disclaimer, the term of this patent is extended or adjusted under 35 U.S.C. 154(b) by 71 days.

(21) Appl. No.: 09/453,622

(22) Filed: Dec. 3, 1999

(51) Int. Cl.[7] ..... A63F 9/12
(52) U.S. Cl. ..... 273/160; 273/156
(58) Field of Search ..... 273/153 R, 156, 273/157 R, 160

(56) References Cited

U.S. PATENT DOCUMENTS

| | | | | |
|---|---|---|---|---|
| D. 206,336 | | 11/1966 | Wilson . | |
| 343,516 | * | 6/1886 | Collins et al. | 273/160 |
| 595,455 | * | 12/1897 | Glidden | 273/160 |
| 1,050,141 | * | 1/1913 | Joy | 273/156 |
| 1,099,159 | | 6/1914 | Banic . | |
| 3,704,892 | | 12/1972 | Moravick et al. . | |
| 3,829,101 | | 8/1974 | Betzoldt . | |
| 4,153,254 | | 5/1979 | Marc . | |
| 4,357,016 | * | 11/1982 | Allison | 273/156 |
| 4,518,165 | | 5/1985 | Shmueli . | |
| 4,534,563 | | 8/1985 | Guenther . | |
| 5,230,508 | * | 7/1993 | Tabler | 273/160 |
| 5,826,873 | * | 10/1998 | Laverimicocca | 273/157 R |

* cited by examiner

*Primary Examiner*—Steven Wong

(57) ABSTRACT

A multi-dimensional puzzle for a way to relieve stress and to provide entertainment. The multi-dimensional puzzle includes a cylindrical base member having lateral slots and a longitudinal slot and a bore; two tubular members also having two lateral slots and a longitudinal slot and a bore; two planar members each having two slots; an arcuate plate member having two slots; three arcuate pieces one of which has a longitudinal slot; and three slot-filling members. All of the pieces and members are placed in such a way to form a solid cylindrical structure.

13 Claims, 4 Drawing Sheets

FIG. 12
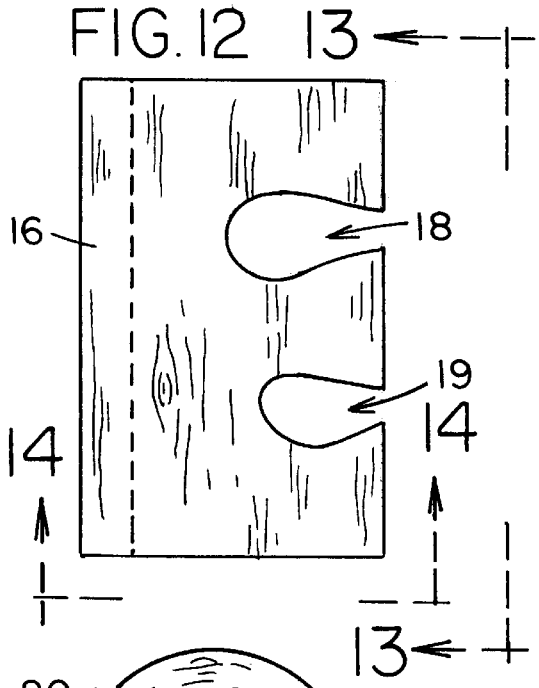
FIG. 13
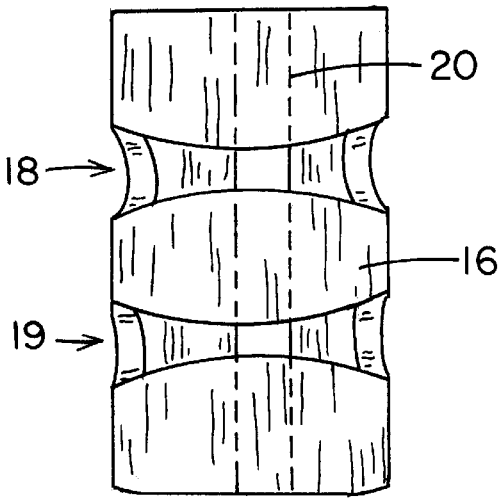
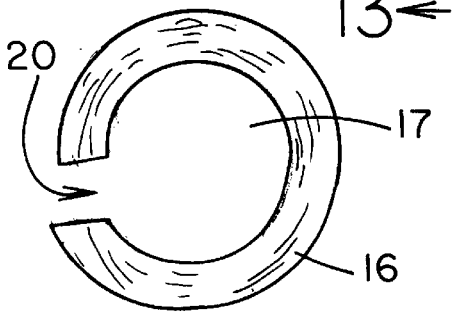
FIG. 14
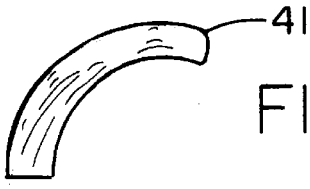
FIG. 16
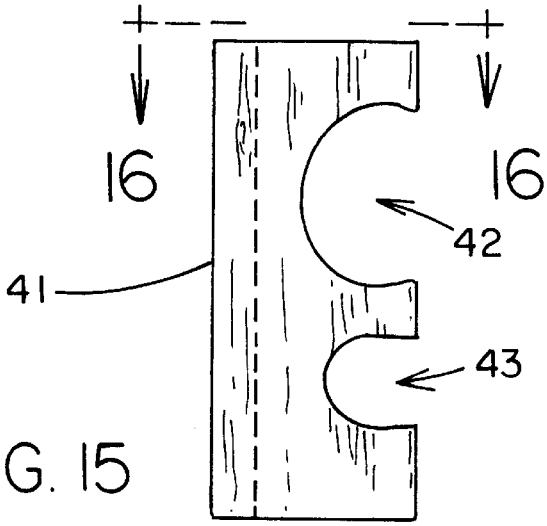
FIG. 15

FIG. 18
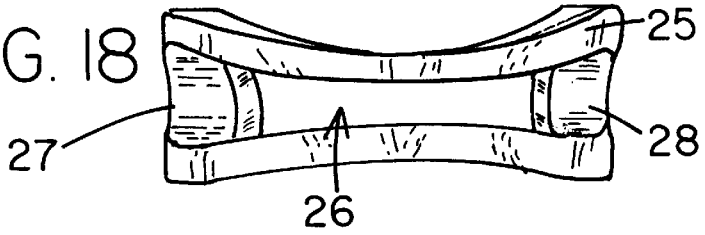
FIG. 19
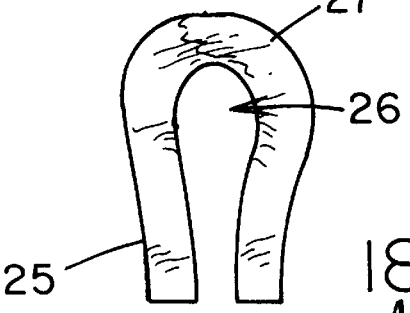
FIG. 17
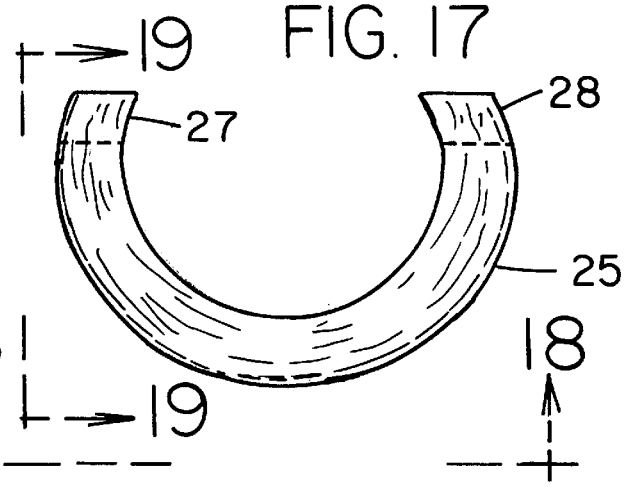
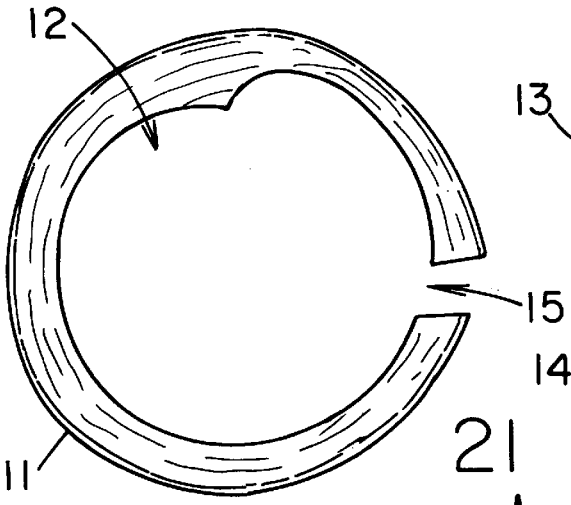
FIG. 21
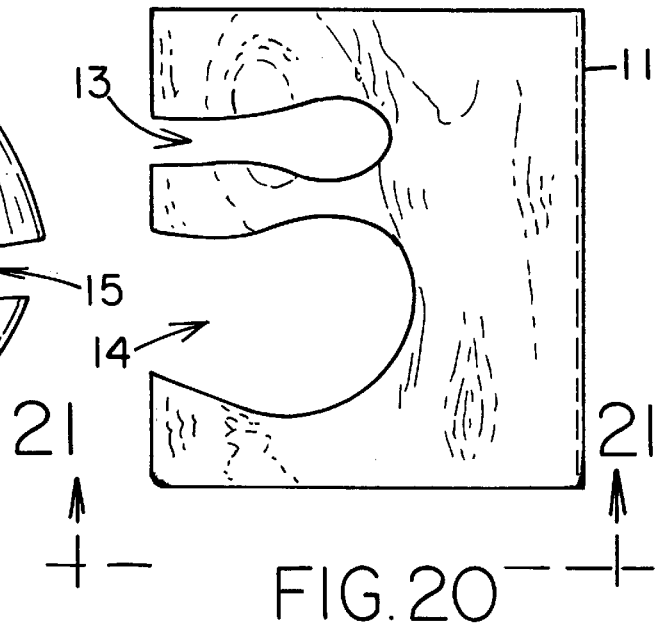
FIG. 20

MULTI-DIMENSIONAL PUZZLE

BACKGROUND OF THE INVENTION

1. Field of the Invention

The present invention relates to multi-dimensional game assembly and more particularly pertains to a new multi-dimensional puzzle for a way to relieve stress and to provide entertainment.

2. Description of the Prior Art

The use of multi-dimensional game assembly is known in the prior art. More specifically, multi-dimensional game assembly heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. Nos. 3,829,101; 3,704,892; 4,518,165; 1,099,159; 4,534,563; and 4,153,254.

While these devices fulfill their respective, particular objectives and requirements, the aforementioned patents do not disclose a new multi-dimensional puzzle. The inventive device includes a cylindrical base member having lateral slots and a longitudinal slot and a bore; two tubular members also having two lateral slots and a longitudinal slot and a bore; two planar members each having two slots; an arcuate plate member having two slots; three arcuate pieces one of which has a longitudinal slot; and three slot-filling members. All of the pieces and members are placed in such a way to form a solid cylindrical structure.

In these respects, the multi-dimensional puzzle according to the present invention substantially departs from the conventional concepts and designs of the prior art, and in so doing provides an apparatus primarily developed for the purpose of a way to relieve stress and to provide entertainment.

SUMMARY OF THE INVENTION

In view of the foregoing disadvantages inherent in the known types of multi-dimensional game assembly now present in the prior art, the present invention provides a new multi-dimensional puzzle construction wherein the same can be utilized for a way to relieve stress and to provide entertainment.

The general purpose of the present invention, which will be described subsequently in greater detail, is to provide a new multi-dimensional puzzle which has many of the advantages of the multi-dimensional game assembly mentioned heretofore and many novel features that result in a new multi-dimensional puzzle which is not anticipated, rendered obvious, suggested, or even implied by any of the prior art multi-dimensional game assembly, either alone or in any combination thereof.

To attain this, the present invention generally comprises a cylindrical base member having lateral slots and a longitudinal slot and a bore; two tubular members also having two lateral slots and a longitudinal slot and a bore; two planar members each having two slots; an arcuate plate member having two slots; three arcuate pieces one of which has a longitudinal slot; and three slot-filling members. All of the pieces and members are placed in such a way to form a solid cylindrical structure.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new multi-dimensional puzzle which has many of the advantages of the multi-dimensional game assembly mentioned heretofore and many novel features that result in a new multi-dimensional puzzle which is not anticipated, rendered obvious, suggested, or even implied by any of the prior art multi-dimensional game assembly, either alone or in any combination thereof.

It is another object of the present invention to provide a new multi-dimensional puzzle which may be easily and efficiently manufactured and marketed.

It is a further object of the present invention to provide a new multi-dimensional puzzle which is of a durable and reliable construction.

An even further object of the present invention is to provide a new multi-dimensional puzzle which is susceptible of a low cost of manufacture with regard to both materials and labor, and which accordingly is then susceptible of low prices of sale to the consuming public, thereby making such multi-dimensional puzzle economically available to the buying public.

Still yet another object of the present invention is to provide a new multi-dimensional puzzle which provides in the apparatuses and methods of the prior art some of the advantages thereof, while simultaneously overcoming some of the disadvantages normally associated therewith.

Still another object of the present invention is to provide a new multi-dimensional puzzle for a way to relieve stress and to provide entertainment.

Yet another object of the present invention is to provide a new multi-dimensional puzzle which includes a cylindrical base member having lateral slots and a longitudinal slot and a bore; two tubular members also having two lateral slots and a longitudinal slot and a bore; two planar members each having two slots; an arcuate plate member having two slots; three arcuate pieces one of which has a longitudinal slot; and three slot-filling members. All of the pieces and members are placed in such a way to form a solid cylindrical structure.

Still yet another object of the present invention is to provide a new multi-dimensional puzzle that provides a functionally challenging game.

Even still another object of the present invention is to provide a new multi-dimensional puzzle that provides uniquely structures pieces and members which when combined together forms a solid cylindrical structure.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 12 is a side elevational view of the first tubular member of the present invention FIG. 13 is a front elevational view of the first tubular member of the present invention.

FIG. 14 is a bottom planar view of the first tubular member of the present invention.

FIG. 15 is a side elevational view of the arcuate plate member of the present invention.

FIG. 16 is a top planar view of the arcuate plate member of the present invention.

FIG. 17 is a top planar view of the first arcuate member of the present invention.

FIG. 18 is a front elevational view of the first arcuate member of the present invention.

FIG. 19 is a side elevational view of the first arcuate member of the present invention.

FIG. 20 is a side elevational view of the base member of the present invention FIG. 21 is a top planar view of the base member of the present invention.

DESCRIPTION OF THE PREFERRED EMBODIMENT

Figure 1:
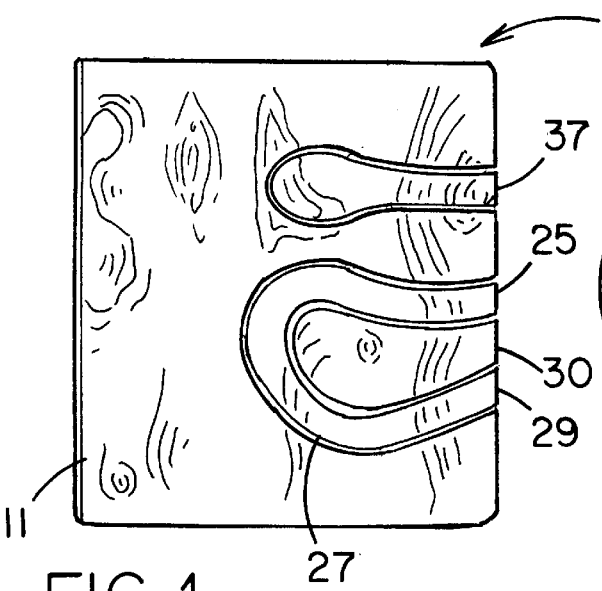
FIG. 1 is a side elevational view of a new multi-dimensional puzzle according to the present invention.
Figure 2:
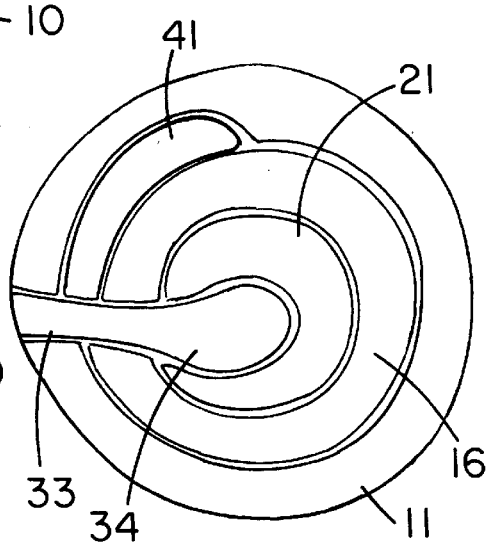
FIG. 2 is a top planar view of the present invention.
Figure 3:
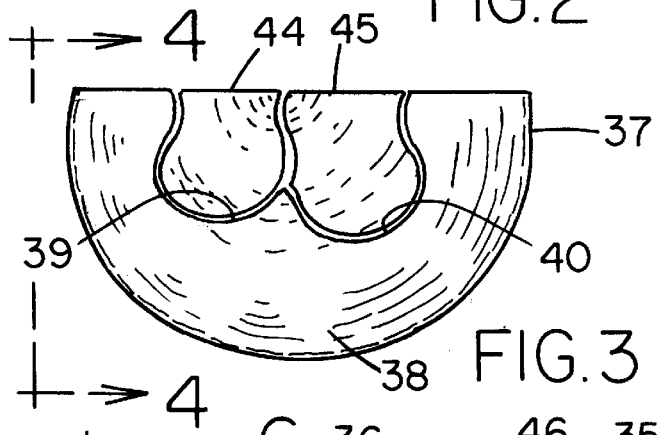
FIG. 3 is a top planar view of the second planar member including the particular slot-filling members of the present invention.
Figure 4:
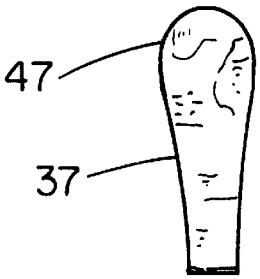
FIG. 4 is a side elevational view of the second planar member of the present invention.
Figure 6:
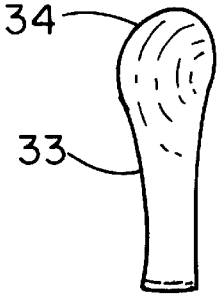
FIG. 6 is a top planar view of the first planar member of the present invention.
Figure 5:
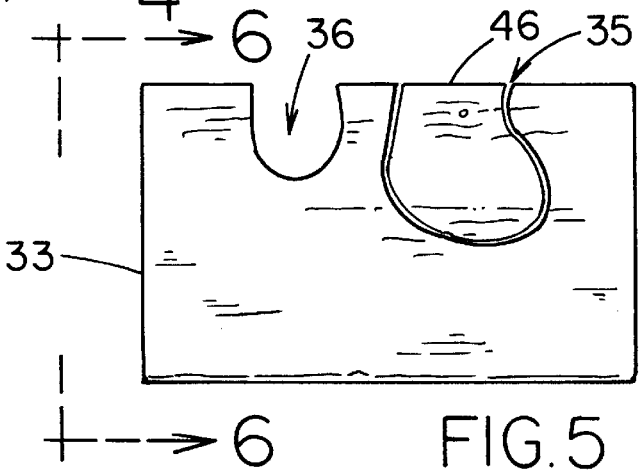
FIG. 5 is a side elevational view of the first planar member including one of the slot-filling members of the present invention.
Figure 8:
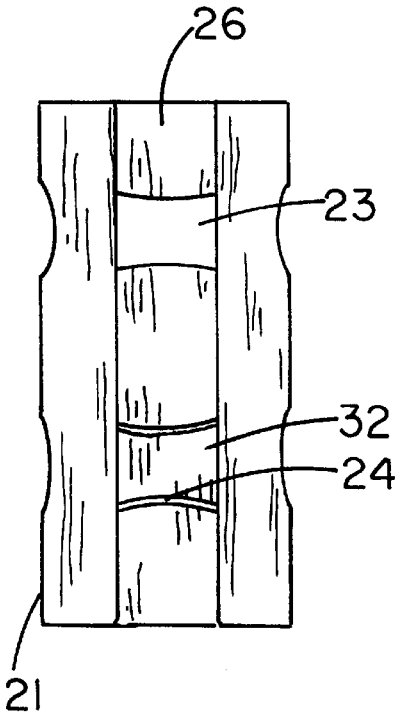
FIG. 8 is a rear elevational view of the second tubular member of the present invention.
Figure 7:
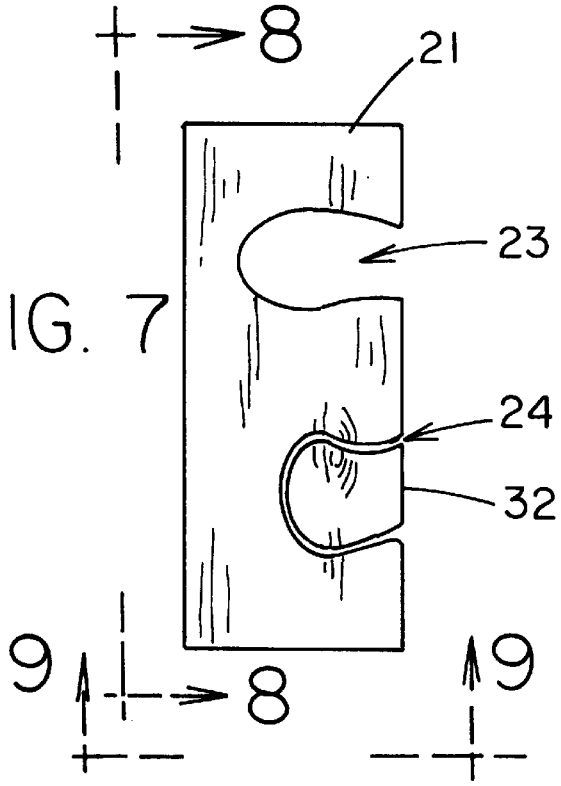
FIG. 7 is a side elevational view of the second tubular member of the present invention.
Figure 9:
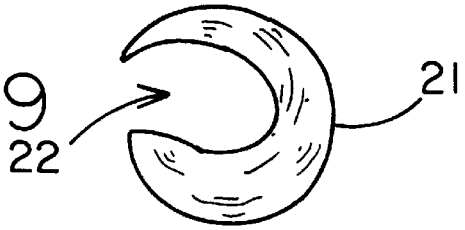
FIG. 9 is bottom planar view of the second tubular member of the present invention.
Figure 10:
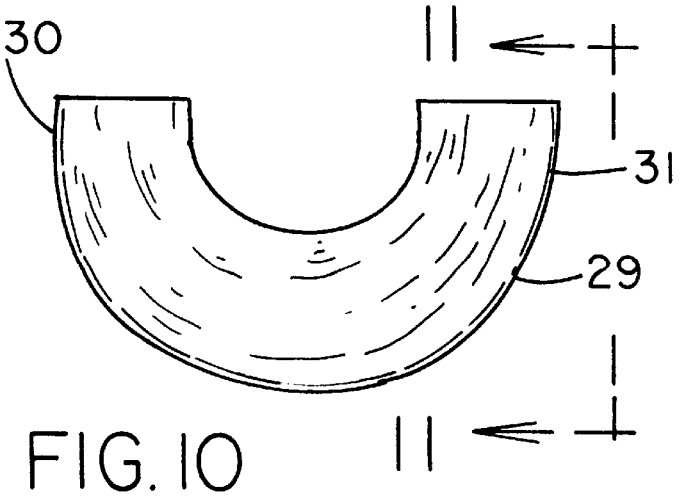
FIG. 10 is a top planar view of the second arcuate member of the present invention.
Figure 11:
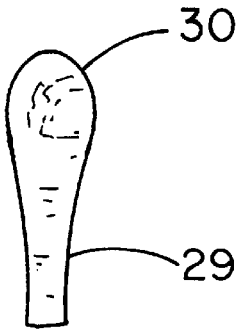
FIG. 11 is a side elevational view of the second arcuate member of the present invention.

With reference now to the drawings, and in particular to FIGS. 1 through 21 thereof, a new multi-dimensional puzzle embodying the principles and concepts of the present invention and generally designated by the reference numeral 10 will be described. As best illustrated in FIGS. 1 through 21, the multi-dimensional puzzle 10 generally comprises a cylindrical base member 11 having an open top and an open bottom and a bore 12 extending therethrough. The base member 11 includes a longitudinal slot 15 extending into the bore 12 and extends from the open top to the open bottom, and further includes a first lateral slot 13 and a second lateral slot 14 spaced apart and extending into the bore 12 opposite of the longitudinal slot 15. The lateral slots 13,14 of the base member 11 are spaced along the length of the base member 11 with the lateral slots 13,14 having ends which are enlarged. A plurality of tubular members 16,21 are adapted to be removably received in the bore 12 of the base member 11. Each tubular member 16,21 has an open top, an open bottom and a bore 17,22 extending therethrough. The tubular members include a first tubular member 16 having a longitudinal slot 20 extending into the bore 17 thereof and extending the length thereof, and further includes a second tubular member 21 adapted to be removably received in the bore 17 of the first tubular member 16 and having a longitudinal slot 26 extending the length thereof. Each of the tubular members 16,21 has a pair of lateral slots 18,19,23,24 extending into a respective bore 17,22 and being spaced along a length thereof with the lateral slots 18,19,23,24 having ends which are enlarged. A plurality of interlocking arcuate pieces are adapted to removably fit into the base member 11 and the tubular members 16,21. The arcuate pieces are essentially C-shaped and include a first arcuate member 25 having enlarged ends 27,28 and a longitudinal slot 26 extending from near one end to near the other end thereof, and also include a second arcuate member 29 having enlarged ends 30,31 and being adapted to interlockingly fit into the longitudinal slot 26 of the first arcuate member 25, and further include a third arcuate member 32 being adapted to interlockingly fit into a lateral slot 24 of the second tubular member 21. The first arcuate member 25 is adapted to interlockingly fit into a second lateral slot 14 of the base member 11 and is adapted to partially extend into a second lateral slot 19 of the first tubular member 16. A plurality of planar members each of which having an enlarged longitudinal edge 34,47 and a pair of slots 35,36,39,40 spaced apart and extending in the longitudinal edge, include a first planar member 33 having a longitudinal portion removably fitted in the longitudinal slots 15,20,26 of the base member 11 and the tubular members 16,21, and further include a second planar member 37 being adapted to interlockingly fit into a first lateral slot 13 of the base member 11 and into a first lateral slot 18 of the first tubular 16 member and to partially extend into the first lateral slot 23 of the second tubular member 21. The first planar member 33 includes another longitudinal edge 34 which is enlarged and is removably disposed in the bores 12,17,22 of the base member 11 and the tubular members 16,21. The second planar member 37 includes an arcuate longitudinal edge to conform to a wall of the base member 11. An arcuate plate member 41 is laterally curved and has a pair of slots 42,43 spaced apart and extending in a longitudinal edge thereof and being interlockingly fitted in the bore 12 of the base member 11. One of the slots 43 of the arcuate plate member 41 is adapted to receive an enlarged end 47 portion of the second planar member 37, and the other of the slots 42 of the arcuate plate member 41 is adapted to receive one of the enlarged ends 28 of the first arcuate member 25. A plurality of slot-filling pieces 44–46 are adapted to removably fit in the slots 35,39,40 of the planar members 33,37. The slot-filling members 44–46 are essentially small node-like bodies shaped to interlockingly fit into respective the slots 35,39,40 of the planar members 33,37.

In use, the user atempts to form a solid cylindrical structure. The user starts with the cylindrical base member 11 and places the first tubular member 16 inside the bore 12 of the cylindrical base member 11, and then places the third arcuate member 32 in the second lateral slot 24 of the second tubular member 21 and places the second tubular member 21 inside the bore 17 of the first tubular member 16. The user then places the arcuate plate member 41 inside the bore 12 of the base member 11, and places one of slot-filling members 46 in a second slot 35 of the first planar member 33, and then places the first planar member 33 in the longitudinal slots 15,20,26 of the base member 11 and the tubular members 16,21. The user then places the second arcuate member 29 in the longitudinal slot 27 of the first arcuate member 25 and places the first arcuate member 25 in the second lateral slots 14,19 of the base member 11 and the first tubular member 21, respectively, and then places the remaining slot-filling members 44,45 in the slots 39,40 of the second planar member 37 and then places the second planar member 37 in the first lateral slots 13,18,23 of the base member 11 and the tubular members 16,21 and in the first slot 36 of the first planar member 33 to complete the cylindrical structure.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A multi-dimensional puzzle comprising:

a cylindrical base member having an open top and an open bottom and a bore extending therethrough;

a plurality of tubular members adapted to be removably received in said bore of said base member, each tubular member having an open top, an open bottom and a bore extending therethrough;

a plurality of interlocking arcuate pieces adapted to removably fit into said base member and said tubular members;

a plurality of planar members each of which having an enlarged longitudinal edge and a pair of slots spaced apart and extending in said longitudinal edge;

an arcuate plate member being laterally curved and having a pair of slots spaced apart and extending in a longitudinal edge thereof and being interlockingly fitted in said bore of said base member; and a plurality of slot-filling pieces adapted to removably fit in said slots of said planar members.

2. A multi-dimensional puzzle as described in claim 1, wherein said base member includes a longitudinal slot extending into said bore and extending from said open top to said open bottom, and further includes a pair of lateral slots spaced apart and extending into said bore opposite of said longitudinal slot.

3. A multi-dimensional puzzle as described in claim 2, wherein said lateral slots of said base member are spaced along the length of said base member, said lateral slots having ends which are enlarged.

4. A multi-dimensional puzzle as described in claim 3, wherein said tubular members include a first tubular member having a longitudinal slot extending into said bore thereof and extending the length thereof, and further includes a second tubular member adapted to be removably received in said bore of said first tubular member and having a longitudinal slot extending the length thereof.

5. A multi-dimensional puzzle as described in claim 4, wherein said each of said tubular members have a pair of lateral slots extending into a respective said bore and being spaced along a length thereof, said lateral slots having ends which are enlarged.

6. A multi-dimensional puzzle as described in claim 5, wherein said arcuate pieces are essentially C-shaped and include a first arcuate member having enlarged ends and a longitudinal slot extending from near one end to near the other end thereof, and also include a second arcuate member having enlarged ends and being adapted to interlockingly fit into said longitudinal slot of said first arcuate member, and further includes a third arcuate member being adapted to interlockingly fit into a lateral slot of said third tubular member.

7. A multi-dimensional puzzle as described in claim 6, wherein said first arcuate member is adapted to interlockingly fit into one of said lateral slots of said base member and is adapted to partially extend into one of said lateral slots of said first tubular member.

8. A multi-dimensional puzzle as described in claim 7, wherein said planar members include a first planar member having a longitudinal portion removably fitted in said longitudinal slots of said base member and said tubular members, and further include a second planar member being adapted to interlockingly fit into the other of said lateral slot of said base member and into the other of said lateral slot of said first tubular member and to partially extend into one of said lateral slots of said second tubular member.

9. A multi-dimensional puzzle as described in claim 8, wherein said first planar member includes another longitudinal edge which is enlarged and is removably disposed in said bores of said base member and said tubular members.

10. A multi-dimensional puzzle as described in claim 9, wherein said second planar member includes an arcuate longitudinal edge to conform to a wall of said base member.

11. A multi-dimensional puzzle as described in claim 10, wherein one of said slots of said arcuate plate member is adapted to receive an enlarged end portion of said second planar member, and the other of said slots of said arcuate plate member is adapted to receive one of said enlarged ends of said first arcuate member.

12. A multi-dimensional puzzle as described in claim 11, wherein said slot-filling members are essentially small node-like bodies shaped to interlockingly fit into respective said slots of said planar members.

13. A multi-dimensional puzzle comprising:

cylindrical base member having an open top and an open bottom and a bore extending therethrough, said base member including a longitudinal slot extending into said bore and extending from said open top to said open bottom, and further including a pair of lateral slots spaced apart and extending into said bore opposite of said longitudinal slot, said lateral slots of said base member being spaced along the length of said base member, said lateral slots having ends which are enlarged;

a plurality of tubular members adapted to be removably received in said bore of said base member, each tubular member having an open top, an open bottom and a bore extending therethrough, said tubular members including a first tubular member having a longitudinal slot extending into said bore thereof and extending the length thereof, and further including a second tubular member adapted to be removably received in said bore of said first tubular member and having a longitudinal slot extending the length thereof, each of said tubular members having a pair of lateral slots extending into a respective said bore and being spaced along a length thereof, said lateral slots having ends which are enlarged;

a plurality of interlocking arcuate pieces adapted to removably fit into said base member and said tubular members, said arcuate pieces being essentially C-shaped and including a first arcuate member having enlarged ends and a longitudinal slot extending from near one end to near the other end thereof, and also including a second arcuate member having enlarged ends and being adapted to interlockingly fit into said longitudinal slot of said first arcuate member, and further including a third arcuate member being adapted to interlockingly fit into a lateral slot of said third tubular member, said first arcuate member being adapted to interlockingly fit into one of said lateral slots of said base member and being adapted to partially extend into one of said lateral slots of said first tubular member;

a plurality of planar members each of which having an enlarged longitudinal edge and a pair of slots spaced apart and extending in said longitudinal edge, said planar members including a first planar member having a longitudinal portion removably fitted in said longitudinal slots of said base member and said tubular members, and further including a second planar member being adapted to interlockingly fit into the other of said lateral slot of said base member and into the other of said lateral slot of said first tubular member and to partially extend into one of said lateral slots of said second tubular member, said first planar member including another longitudinal edge which is enlarged and is removably disposed in said bores of said base member and said tubular members, said second planar member including an arcuate longitudinal edge to conform to a wall of said base member;

an arcuate plate member being laterally curved and having a pair of slots spaced apart and extending in a longitudinal edge thereof and being interlockingly fitted in said bore of said base member, one of said slots of said arcuate plate member being adapted to receive an enlarged end portion of said second planar member, and the other of said slots of said arcuate plate member being adapted to receive one of said enlarged ends of said first arcuate member; and a plurality of slot-filling pieces adapted to removably fit in said slots of said planar member, said slot-filling members are essentially small node-like bodies shaped to interlockingly fit into respective said slots of said members.

* * * * *